US011172760B1

(12) United States Patent
Market et al.

(10) Patent No.: US 11,172,760 B1
(45) Date of Patent: Nov. 16, 2021

(54) HANGING STORAGE ENCLOSURE

(71) Applicants: Jason A. Market, Charlotte, NC (US); Elizabeth B. Stec Market, Charlotte, NC (US)

(72) Inventors: Jason A. Market, Charlotte, NC (US); Elizabeth B. Stec Market, Charlotte, NC (US)

( * ) Notice: Subject to any disclaimer, the term of this patent is extended or adjusted under 35 U.S.C. 154(b) by 0 days.

(21) Appl. No.: 16/875,389

(22) Filed: May 15, 2020

(51) Int. Cl.

| | |
|---|---|
| ***A47G 25/00*** | (2006.01) |
| ***A47F 5/08*** | (2006.01) |
| ***A47B 61/02*** | (2006.01) |
| ***A47B 88/42*** | (2017.01) |
| ***A47B 95/00*** | (2006.01) |

(52) U.S. Cl.
CPC ..... *A47B 61/02* (2013.01); *A47B 88/42* (2017.01); *A47B 95/008* (2013.01)

(58) Field of Classification Search
CPC ..... A47B 61/02; A47B 88/42; A47B 95/008
See application file for complete search history.

(56) References Cited

U.S. PATENT DOCUMENTS 2,254,431 A * 9/1941 Levine ..... A47B 88/42 312/201
2,419,013 A * 4/1947 Ducey ..... E05B 65/0811 70/99
3,025,122 A * 3/1962 Millman ..... A47B 95/008 312/245
3,335,872 A * 8/1967 Dodich ..... A47G 25/746 211/85.3
3,897,122 A * 7/1975 McEvers ..... A47G 25/746 312/321
3,909,093 A * 9/1975 Lundberg ..... A47B 88/42 312/331
4,314,733 A * 2/1982 Smith ..... A47B 88/42 211/50
4,585,127 A * 4/1986 Benedict ..... A47B 61/02 211/34
4,854,656 A * 8/1989 O'Keefe ..... A45C 11/16 312/334.23
5,076,442 A * 12/1991 Hakeem ..... A47B 46/00 211/34
5,114,017 A 5/1992 Doyel
5,468,063 A * 11/1995 Simonek ..... A47B 88/42 312/287
5,472,082 A 12/1995 Thiele
5,582,306 A 12/1996 Balter et al.
(Continued)

FOREIGN PATENT DOCUMENTS

DE 2907970 A1 * 9/1980 ..... A47B 95/008

*Primary Examiner* — Kimberley S Wright
(74) *Attorney, Agent, or Firm* — Jeffrey C. Watson; Mathew L. Grell; Grell & Watson Patent Attorneys LLC

(57) ABSTRACT

A hanging storage enclosure includes a main frame, a hanging mechanism, a top slide and a bottom slide. The main frame has a hollow interior having a top side, a bottom side, and an open front end. The hanging mechanism is on the top side. The hanging mechanism is configured to hang the main frame from an object. The top slide is positioned on the top side and the bottom slide is positioned on the bottom side. The top slide is configured to slide in and out of the top side of the main frame for positioning the top side. The bottom slide is configured to slide in and out of the bottom side for positioning the bottom side.

19 Claims, 14 Drawing Sheets

(56) References Cited

U.S. PATENT DOCUMENTS

| | | | | |
|---|---|---|---|---|
| 6,161,686 | A | 12/2000 | Simon et al. | |
| 6,412,892 | B1 * | 7/2002 | Bonat | A47B 88/42 312/334.25 |
| 6,719,157 | B2 | 4/2004 | Stoddart et al. | |
| 6,732,659 | B2 | 5/2004 | Poon | |
| 7,604,102 | B2 | 10/2009 | Albritton | |
| 7,681,728 | B2 | 3/2010 | Sabounjian | |
| 8,627,950 | B2 | 1/2014 | Bland | |
| 9,033,294 | B2 * | 5/2015 | Cattaneo | A47B 95/008 248/221.11 |
| 10,072,873 | B1 * | 9/2018 | Ostera | F24H 9/2028 |
| 10,219,619 | B1 * | 3/2019 | Smith | A47F 5/08 |
| 10,244,865 | B1 * | 4/2019 | Chauhan | E05B 69/006 |
| 10,477,991 | B1 * | 11/2019 | Fragala | A47F 7/03 |
| 2005/0074187 | A1 | 4/2005 | Sabounjian | |
| 2005/0140253 | A1 | 6/2005 | Fu | |
| 2007/0080120 | A1 | 4/2007 | Greiner | |
| 2007/0163977 | A1 | 7/2007 | Wang | |
| 2008/0116160 | A1 | 5/2008 | McNicholas | |
| 2010/0163505 | A1 | 7/2010 | Wang | |
| 2010/0164339 | A1 | 7/2010 | Jenkins | |
| 2011/0278249 | A1 | 11/2011 | Wang | |
| 2012/0018602 | A1 * | 1/2012 | Cattaneo | A47B 95/008 248/222.11 |
| 2012/0138556 | A1 | 6/2012 | Wang | |
| 2012/0168395 | A1 | 7/2012 | Wang | |
| 2017/0238709 | A1 * | 8/2017 | Chen | A47B 88/969 |
| 2018/0317647 | A1 | 11/2018 | Felsenthal et al. | |
| 2019/0099028 | A1 | 4/2019 | Felsenthal et al. | |

* cited by examiner

HANGING STORAGE ENCLOSURE

FIELD OF THE DISCLOSURE

The present disclosure is related to storage and more particularly closet storage. More specifically, the present disclosure is related to a hanging storage enclosure.

BACKGROUND

Generally speaking, a closet may refer to a dedicated space within a dwelling used for storage, particularly that of clothes. Fitted closets are built into the walls of a house or apartment so that they take up no visible space in the room. Closets are often built under stairs, thereby using awkward space that would otherwise go unused.

Closets generally include integrated shelving that can be made from different materials with various advantages and disadvantages. Wire shelving is cheap and may be moderately difficult to install, but cannot hold much weight without giving in. Wood shelving may be more expensive and difficult to install, but is sturdier than wire. Tube shelving may be easy to install, with fewer pieces that require minimal cutting or measuring.

No matter what the closet configuration or the material used in the integrated closet shelving, most closets include a closet rod utilized for hanging clothing, jackets or the like. For example, a coat closet with a closet rod may be used to store coats, jackets, hoodies, sweatshirts, gloves, hats, scarfs, and boots/shoes. Some closets may have a mounted closet rod with dedicated open space below that can be used to store items in boxes or bins. It is very common for closets to include a top shelf for storage above the closet rod.

Regardless of the closet design or layout, the area dedicated for the placement of the closet rod is typically a big portion of the overall closet space. As such, there is clearly a need and/or desire to utilize this space efficiently. In addition, closets are often left open or function as part of the décor of the home. As such, there is clearly a need and/or desire to present the area and space of the closet rod attractively with various color and material options for the various tastes and desires of the occupant.

The instant disclosure may be designed to address at least certain aspects of the problems or needs discussed above by providing a hanging storage enclosure.

SUMMARY

The present disclosure may solve the aforementioned limitations of the currently available storage and organization devices, like closet organization devices, by providing a hanging storage enclosure. The disclosed hanging storage enclosure may generally include a main frame, a hanging mechanism, a top slide and a bottom slide. The main frame may have a hollow interior having a top side, a bottom side, and an open front end. The hanging mechanism may be on the top side of the main frame. The hanging mechanism may be configured to hang the main frame from an object. The top slide may be positioned on the top side of the main frame. The top slide may be configured to slide in and out of the top side of the main frame, wherein the top slide may be configured for positioning the top side of the main frame. The bottom slide may be positioned on the bottom side of the main frame. The bottom slide may be configured to slide in and out of the bottom side of the main frame, wherein the bottom slide may be configured for positioning the bottom side of the main frame.

One feature of the disclosed hanging storage enclosure may be that the combination of the hanging mechanism, the top slide and the bottom slide may be configured to stabilize and position the hanging storage enclosure horizontally below the object. As an example, the object may be a closet rod where the hanging mechanism may be configured to hang the main frame from the closet rod. Wherein, the combination of the hanging mechanism, the top slide and the bottom slide may be configured to stabilize and position the hanging storage enclosure horizontally below the closet rod. As an example, when the closet rod is positioned in front of a rear closet wall, the top slide may be configured for positioning the top side of the main frame relative to the rear closet wall below the closet rod. Likewise, the bottom slide may be configured for positioning the bottom side of the main frame relative to the rear closet wall below the closet rod. Wherein, the combination of the hanging mechanism, the top slide and the bottom slide may be configured to stabilize and position the hanging storage enclosure horizontally below the closet rod while utilizing the rear closet wall for stabilizing and leveling the horizontal position of the hanging storage enclosure below the closet rod.

Another feature of the disclosed hanging storage enclosure may be that the hanging mechanism can be configured to lock onto the object or closet rod. Wherein, in select embodiments, when the hanging mechanism is locked onto the closet rod, the hanging mechanism may be configured to stabilize the hanging storage enclosure from traveling transversely along the closet rod. In other select embodiments, when the hanging mechanism is locked onto the closet rod, the hanging mechanism may prevent the hanging storage enclosure from lifting vertically and inadvertently being removed from the object or closet rod. In other select embodiments, when the hanging mechanism is locked onto the closet rod, the hanging mechanism may be configured to reduce the hanging storage enclosure from rotating about the closet rod. In other select possibly preferred embodiments, when the hanging mechanism is locked onto the closet rod, the hanging mechanism may be configured to stabilize the hanging storage enclosure from traveling transversely along the closet rod and to reduce the hanging storage enclosure from rotating about the closet rod.

In select embodiments of the disclosed hanging storage enclosure, the hanging mechanism can include a top member with a notch sized and configured to receive the object. A front member may be configured to support the top member at an elevated position above the top side of the main frame. In addition, in select embodiments, an adjustable lock may be included with the hanging mechanism. The adjustable lock may be configured for locking the object in the notch of the top member. The adjustable lock may be configured to adjust to various size objects received within the notch of the top member for locking the various sized objects in the notch of the top member. In select embodiments, the adjustable lock may include an angled member and a movable groove plate. The angled member may have a friction top portion, and a rounded bottom portion with teeth. The angled member may be connected to the hanging mechanism at a pivot point configured to pivot the friction top portion towards and away from the notch of the top member. In addition, the movable groove plate may be configured to rotate the angled member via the rounded bottom portion with teeth. Whereby, when the movable groove plate is moved toward the hanging mechanism, the friction top portion of the angled member may be moved towards the notch of the top member for locking the object into the notch. In addition, when the movable groove plate is moved away from the hanging mechanism, the friction top portion of the angled member may be moved away from the notch of the top member for unlocking the object out of the notch. In select embodiments, a release button may be included that is configured for releasing the movable groove plate and allow it to reverse direction thereby unlocking the object from the notch. In select embodiments, the notch of the top member may include a trapezoid shape with a wide open bottom. In select embodiments, the interior of the trapezoid shape may have friction grooves.

In select embodiments of the disclosed hanging storage enclosure, the top slide positioned on the top side of the main frame may include a top horizontal bracket with a top vertical bracket at a top distal end of the top horizontal bracket. Wherein the top vertical bracket may be configured to be slid to and from the top side of the main frame. In select embodiments, the top vertical bracket may extend vertically upward from the top horizontal bracket and may include a top rounded protrusion at its top configured for safely positioning the top side of the main frame against a back closet wall. In select embodiments, the top horizontal bracket may include a top slot therethrough configured to receive a top locking mechanism while sliding along the top side of the main frame. The top locking mechanism may be configured for locking the top horizontal bracket in position on the top side of the main frame in a locked top position, and for releasing the top horizontal bracket to slide along the top side of the main frame in a top release position In select embodiments of the disclosed hanging storage enclosure, the bottom slide positioned on the bottom side of the main frame may include a bottom horizontal bracket with a bottom vertical bracket at a bottom distal end. Wherein, the bottom vertical bracket may be configured to be slid to and from the bottom side of the main frame. In select embodiments, the bottom vertical bracket may extend vertically downwards from the bottom horizontal bracket and may include a bottom rounded protrusion at its bottom configured for safely positioning the bottom side of the main frame against the back closet wall. In select embodiments, the bottom horizontal bracket may include a bottom slot therethrough configured to receive a bottom locking mechanism while sliding along the bottom side of the main frame. The bottom locking mechanism may be configured for locking the bottom horizontal bracket in position on the bottom side of the main frame in a locked bottom position, and for releasing the bottom horizontal bracket to slide along the bottom side of the main frame in a bottom release position.

In select embodiments of the disclosed hanging storage enclosure, at least one drawer may be included. The drawer or drawers may be configured to fit inside the hollow interior of the main frame, where the drawer or drawers may be configured to slide in and out of the open front end of the main frame. In select embodiments, each of the drawers may include at least one top rail configured to slide in and out of a corresponding number of top tracks positioned under the top side of the main frame. In addition, in select embodiments of the drawer, at least one bottom rail may be included that is configured to slide in and out of a corresponding number of bottom tracks positioned on top of the bottom side of the main frame. In other select embodiments of the drawer, a vertical panel may be included that may be connected between the top rail and the bottom rail. The vertical panel may be configured for storing a variety of items on one or both sides. In select embodiments, the vertical panel may include a plurality of niches configured for attaching a plurality of storage devices on one or both sides of the vertical panel of the drawer. The storage devices may include, but are not limited to, a shelf, a container, a horizontal bar, a rack, a hook, a dowel, the like, or combinations thereof. In other select embodiments of the drawer, a front cap may be included. The front cap may be configured for closing the open front end of the main frame when the drawer is slid into the main frame. Wherein, when the drawer is opened thereby creating additional rotational forces about the closet rod, the combination of the hanging mechanism, the top slide and the bottom slide is configured to stabilize and position the hanging storage enclosure in a level position horizontally below the closet rod while utilizing the rear closet wall for stabilizing the horizontal position below the closet rod even with the drawer slid completely out of the main frame.

Another feature of the disclosed hanging storage enclosure may be that the vertical panel of the drawer may be a reversible panel. The reversible panel may be re-positioned to allow the storage of the variety of items on either the left or the right side of the drawer. In select embodiments, the reversible panel may include four L-shaped slots. Each of the four L-shaped slots may be positioned approximate a corner of the reversible panel. Accordingly, the drawer may include two sets of four corresponding pins, where one set of the four corresponding pins is configured for positioning the reversible panel on the left side of the drawer, and the other set of the four corresponding pins is configured for positioning the reversible panel on the right side of the drawer.

Another feature of the disclosed hanging storage enclosure may be the inclusion of an opening locking mechanism. The opening locking mechanism may be configured to lock the open front end of the main frame for securing items inside of the main frame. In select embodiments, the opening locking mechanism may include a cutout and a holed protrusion. The cutout may be in the bottom side of the main frame. The holed protrusion may be positioned in the cutout on the bottom side of the main frame. The holed protrusion may be configured for receiving a padlock for locking a drawer to the holed protrusion thereby locking the drawer inside of the main frame.

In select embodiments of the disclosed hanging storage enclosure, the main frame may include a left side and a right side configured for concealing the drawer in the main frame of the hanging storage enclosure. In select embodiments, the left side or the right side may include an indention configured for gripping the front cap of the drawer for sliding out the drawer from the main frame.

In another aspect, the instant disclosure embraces the hanging storage enclosure in any of the various embodiments and/or combination of embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
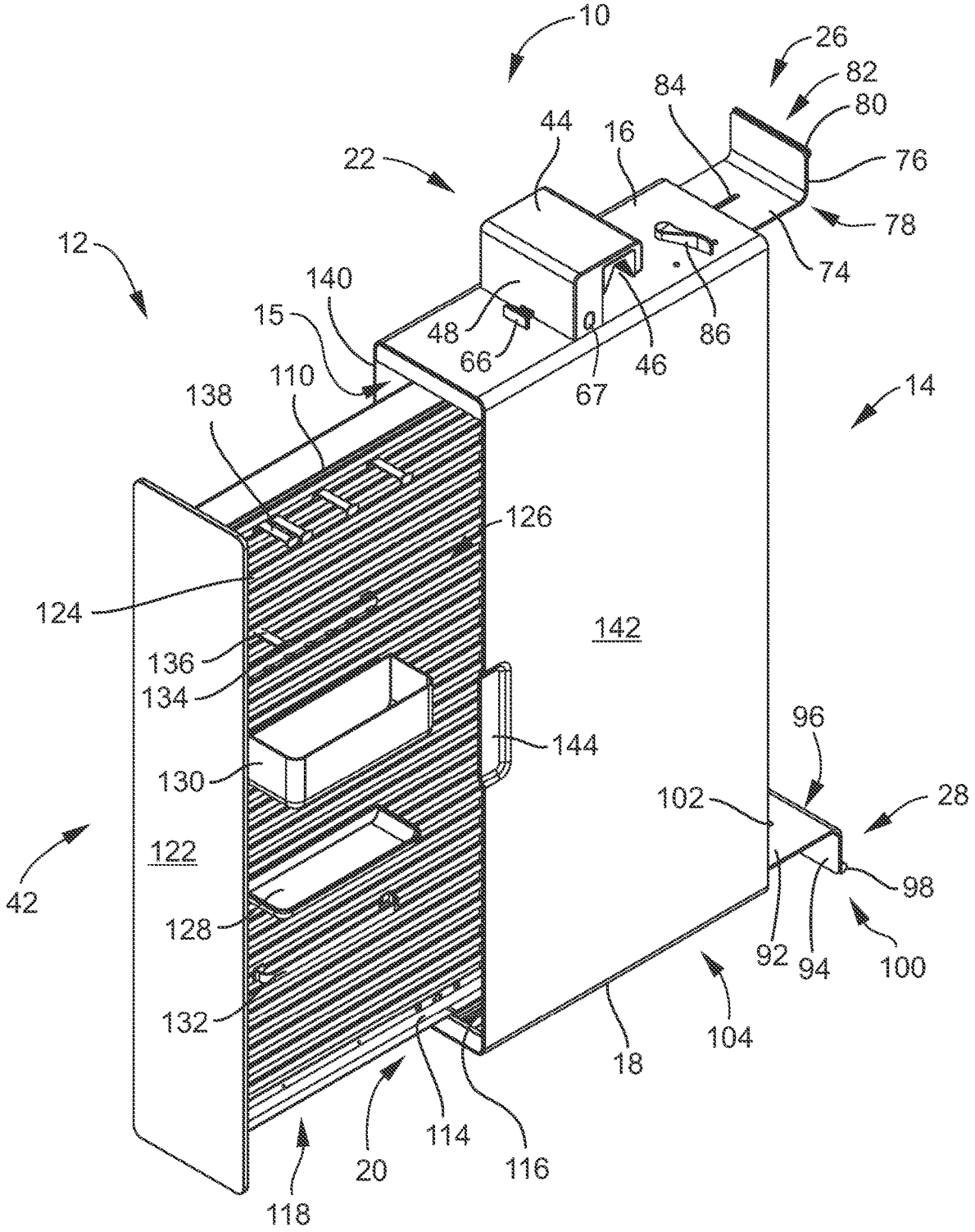
FIG. 1 is a front top perspective view of the hanging storage enclosure according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-14, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

The present disclosure solves the aforementioned limitations of the currently available devices and methods of storage and organization by providing a hanging storage enclosure 10. Hanging storage enclosure 10 may generally include main frame 14, hanging mechanism 22, top slide 26 and bottom slide 28. Main frame 14 may be for providing the structure of frame for hanging storage enclosure 10. Main frame 14 may have hollow interior 15. Main frame 14 may have top side 16, bottom side 18, and open front end 20. Hanging mechanism 22 may be on top side 16 of main frame 14. Hanging mechanism 22 may be configured to hang main frame 14 from object 24. Top slide 26 may be positioned approximate, on, or in top side 16 of main frame 14. Top slide 26 may be configured to slide in and out of top side 16 of main frame 14. Top slide 26 may be configured for positioning top side 16 of main frame 14. Bottom slide 28 may be positioned approximate, on, or in bottom side 18 of main frame 14. Bottom slide 28 may be configured to slide in and out of bottom side 18 of main frame 14. Bottom slide 28 may be configured for positioning bottom side 18 of main frame 14.

Figure 6:
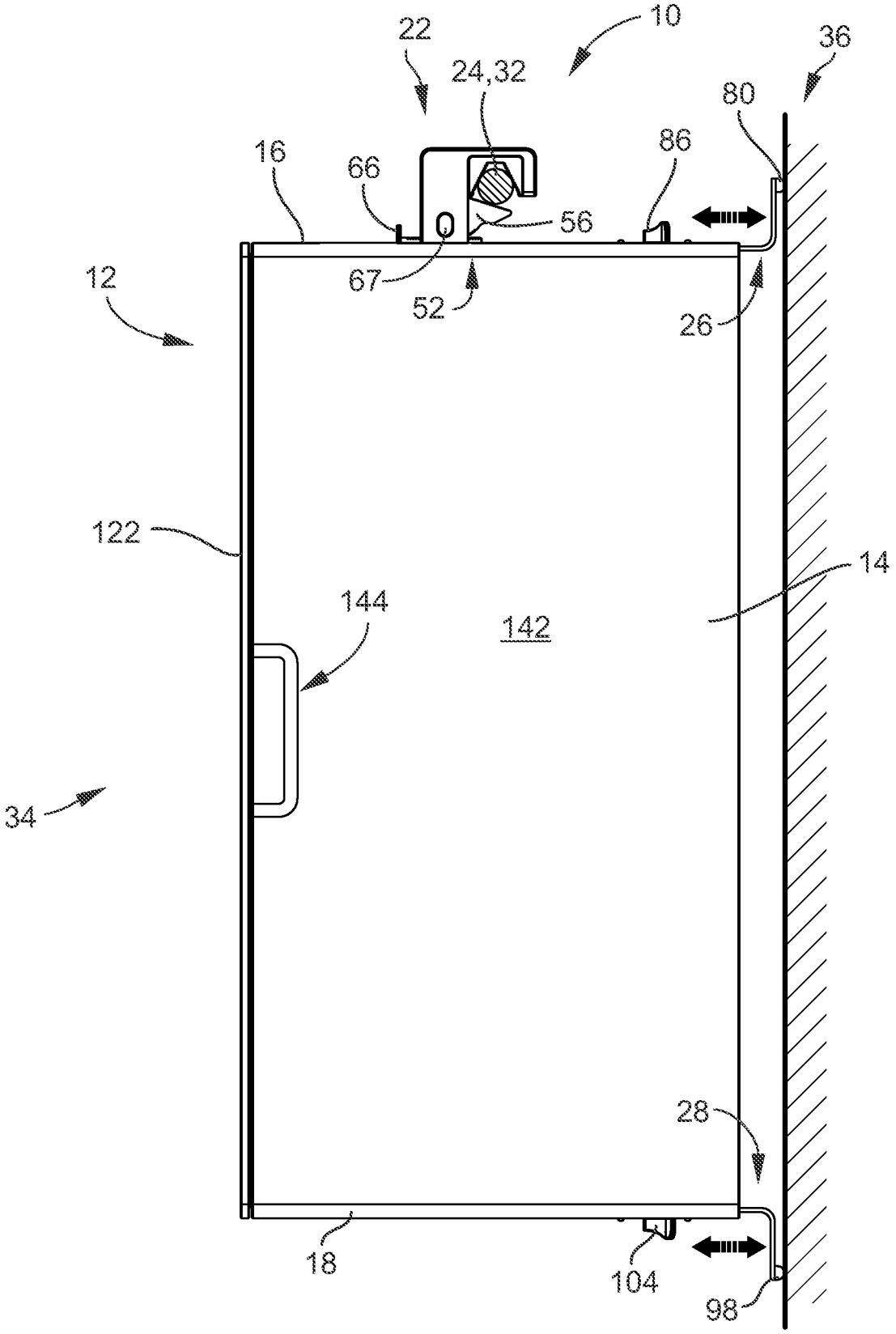
FIG. 6 is a right side view of the hanging storage enclosure of FIG. 1 hanging on a closet rod and positioned near the back wall of the closet.
Figure 7:
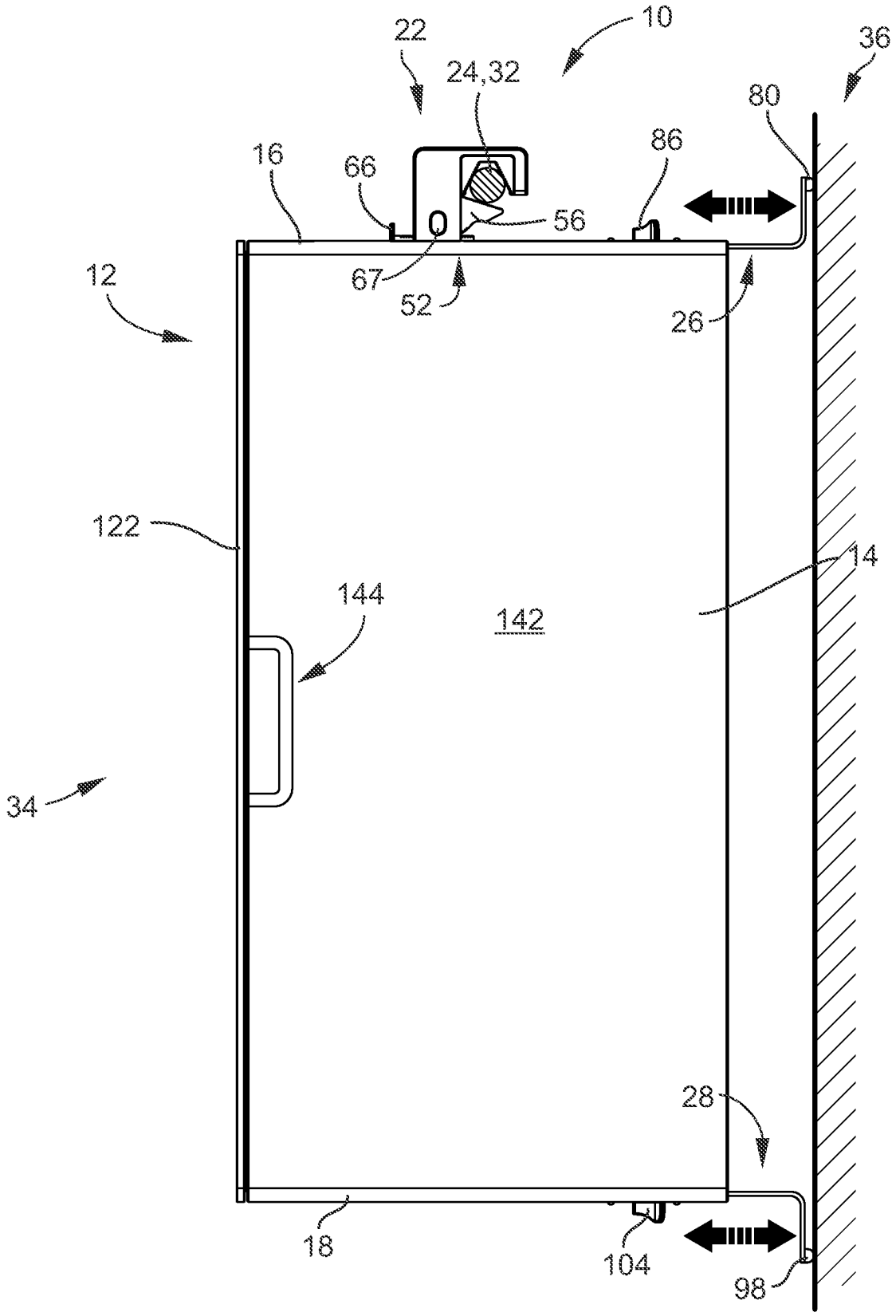
FIG. 7 is a right side view of the hanging storage enclosure of FIG. 1 hanging on a closet rod and positioned further from the back wall of the closet as shown in FIG. 6.
Figure 8:
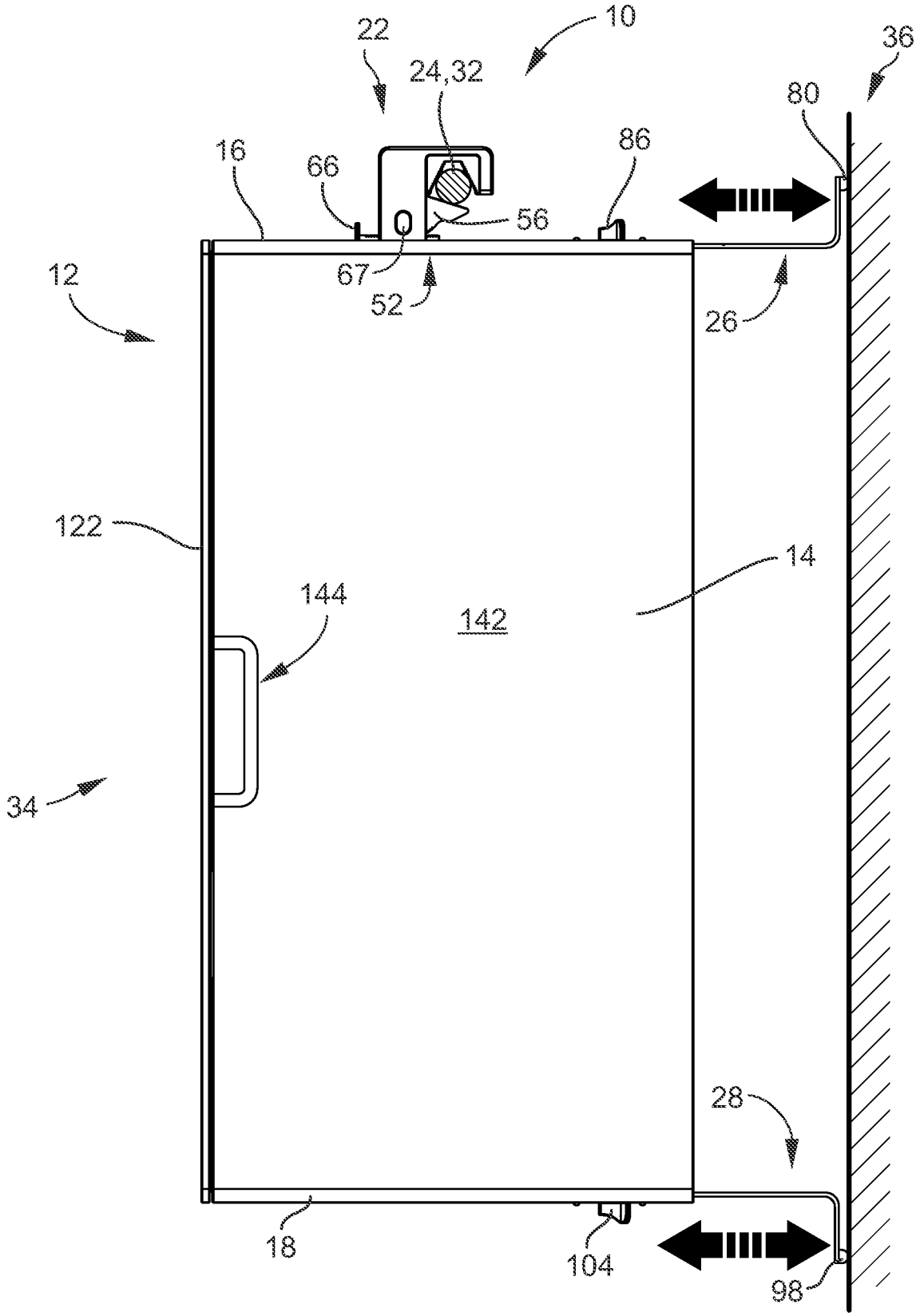
FIG. 8 is a right side view of the hanging storage enclosure of FIG. 1 hanging on a closet rod and positioned further from the back wall of the closet as shown in FIG. 7.
Figure 9:
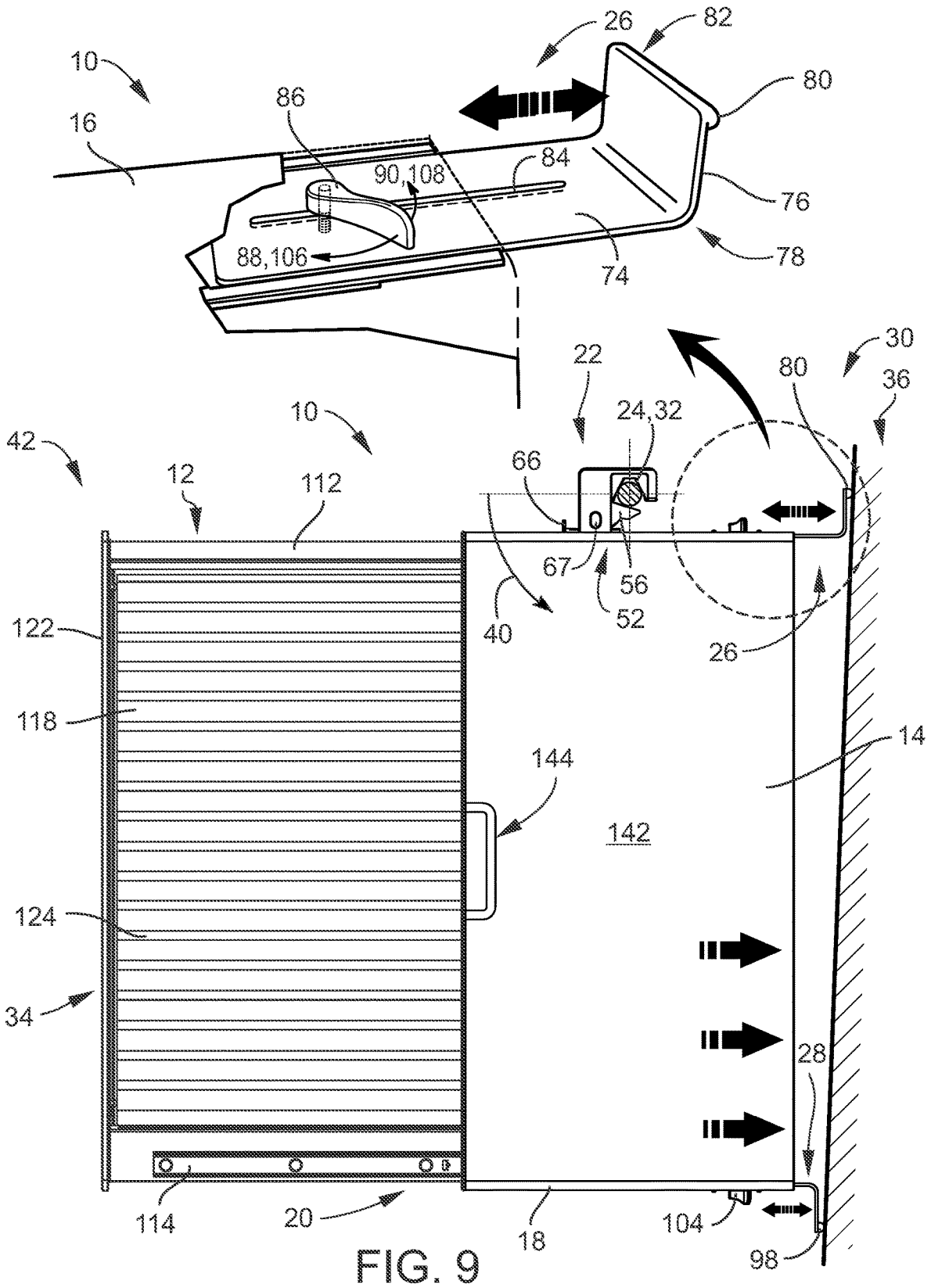
FIG. 9 is a right side view of the hanging storage enclosure of FIG. 1 hanging on a closet rod and positioned horizontally against a non-vertical wall with a zoomed in version of the top showing the operation of the top locking mechanism for locking the top slide in place.

One feature of hanging storage enclosure 10 may be that combination 30 of hanging mechanism 22, top slide 26 and bottom slide 28 may be configured to stabilize and position hanging storage enclosure 10 in a level position horizontally below object 24. This horizontal positioning 34 of hanging storage enclosure 10 is best shown in FIGS. 5-10. As an example, object 24 may be closet rod 32, as shown specifically in FIGS. 5-10 and 14. Hanging mechanism 22 may be configured to hang main frame 14 from closet rod 32. Wherein, the combination 30 of hanging mechanism 22, top slide 26 and bottom slide 28 may be configured to stabilize and position hanging storage enclosure 10 horizontally below closet rod 32. As an example, and clearly not limited thereto, when closet rod 32 is positioned in front of rear closet wall 36, as shown in FIGS. 5-11 and 14, top slide 26 may be configured for positioning top side 16 of main frame 14 relative to rear closet wall 36 below closet rod 32. Likewise, bottom slide 28 may be configured for positioning bottom side 18 of main frame 14 relative to rear closet wall 36 below closet rod 32. Wherein, the combination 30 of hanging mechanism 22, top slide 26 and bottom slide 28 may be configured to stabilize and position hanging storage enclosure 10 horizontally below closet rod 32 while utilizing rear closet wall 36 for stabilizing horizontal position or orientation 34 of hanging storage enclosure 10 below closet rod 32. As shown in FIG. 6, in embodiments where rear closet wall 36 is not very deep behind closet rod 32, top slide 26 and bottom slide 28 may be slid in toward main frame 14 for stabilizing hanging storage enclosure 10 against such a shallow rear closet wall 36 orientation relative to closet rod 32. As shown in FIG. 7, in embodiments where rear closet wall 36 is an average position behind closet rod 32, top slide 26 and bottom slide 28 may be slid partially away from main frame 14 for stabilizing hanging storage enclosure 10 against such an average depth of rear closet wall 36 orientation relative to closet rod 32. As shown in FIG. 8, in embodiments where rear closet wall 36 is in a very deep position behind closet rod 32, top slide 26 and bottom slide 28 may be slid completely away from main frame 14 for stabilizing hanging storage enclosure 10 against such deep rear closet wall 36 orientation relative to closet rod 32. As shown in FIG. 9, when rear closet wall 36 is not vertical or angled in one direction or the other, top slide 26 may be slid out a different distance from top side 16 from main frame 14 as bottom slide 28 is slid out from bottom side 18. The distances from main frame 14 of top slide 26 and bottom slide 28 may be varied depending on the slope or angle of rear closet wall 36 to maintain hanging storage enclosure 10 in horizontal orientation 34.

Hanging mechanism 22 may be included with hanging storage enclosure 10. Hanging mechanism 22 may be for hanging main frame 14 from object 24, like closet rod 32, or any other fixed objects, like hooks, the like, etc. Hanging mechanism 22 may include any device, members, mechanism, means or combination thereof, for hanging main frame 14 from object 24, like closet rod 32. In select embodiments, hanging mechanism 22 can be configured to lock onto closet rod 32. Wherein, in select embodiments, when hanging mechanism 22 is locked onto closet rod 32, hanging mechanism 22 may be configured to stabilize hanging storage enclosure 10 from traveling transversely along closet rod 32, as shown by transverse arrows 38 in FIG. 5. In other select embodiments, when hanging mechanism 22 is locked onto object 24, like closet rod 32, hanging mechanism 22 may be configured to prevent hanging storage enclosure 10 from lifting vertically and inadvertently being removed from object 24, like closet rod 32. In other select embodiments, when hanging mechanism 22 is locked onto closet rod 32, hanging mechanism 22 may be configured to reduce hanging storage enclosure 10 from rotating about closet rod 32, as shown by rotational arrow 40 in FIG. 9. In other select possibly preferred embodiments, when hanging mechanism 22 is locked onto closet rod 32, hanging mechanism 22 may be configured to stabilize hanging storage enclosure 10 from traveling transversely along closet rod 32 and to reduce hanging storage enclosure 10 from rotating about closet rod 32.

Figure 10A:
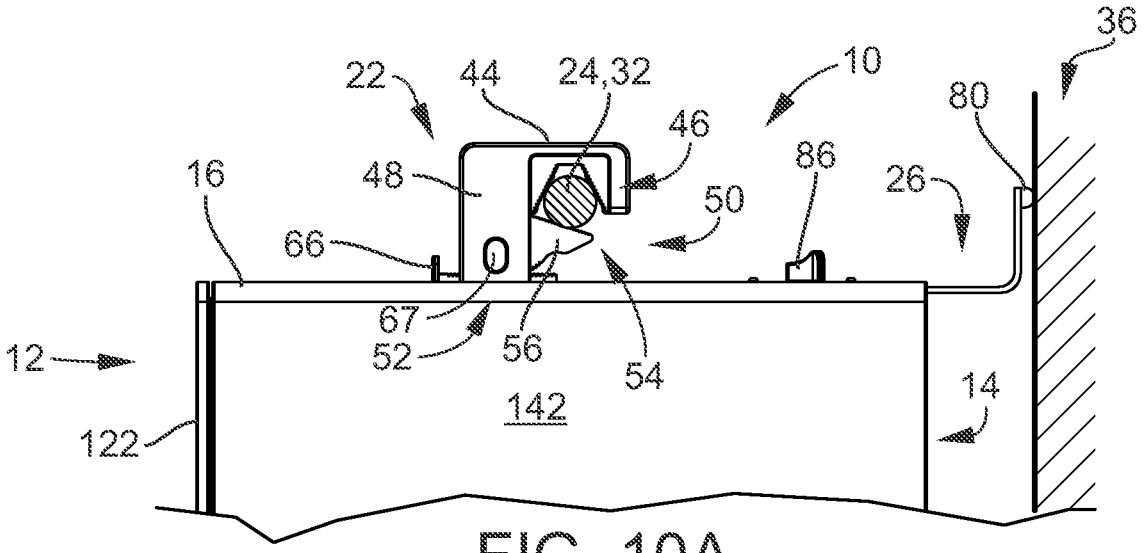
FIG. 10A is right side view of the top portion of the hanging storage enclosure of FIG. 1 hanging on a standard circular closet rod.
Figure 10B:
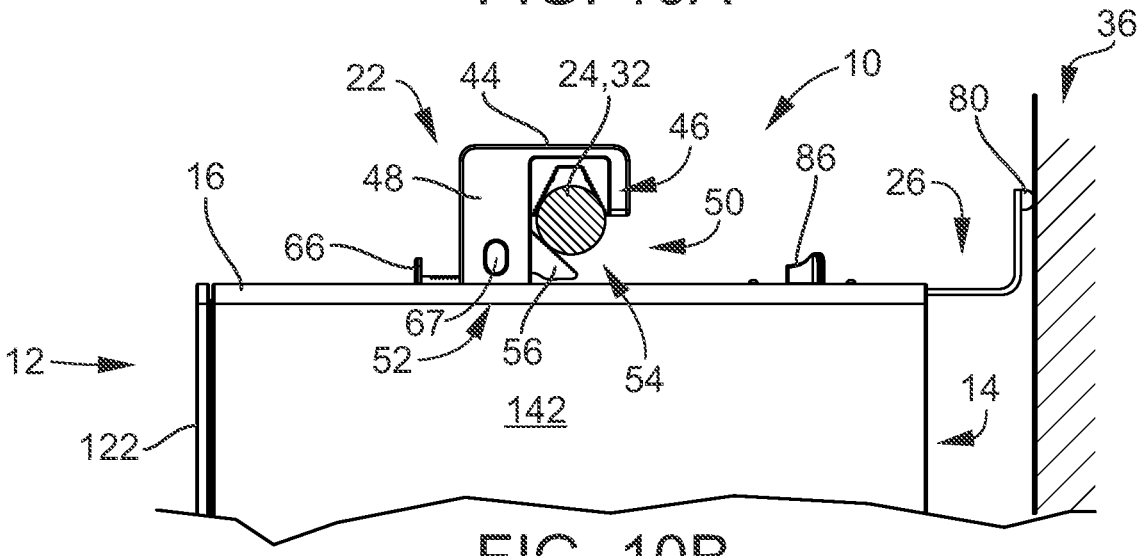
FIG. 10B is right side view of the top portion of the hanging storage enclosure of FIG. 1 hanging on an oversized circular closet rod.
Figure 10C:
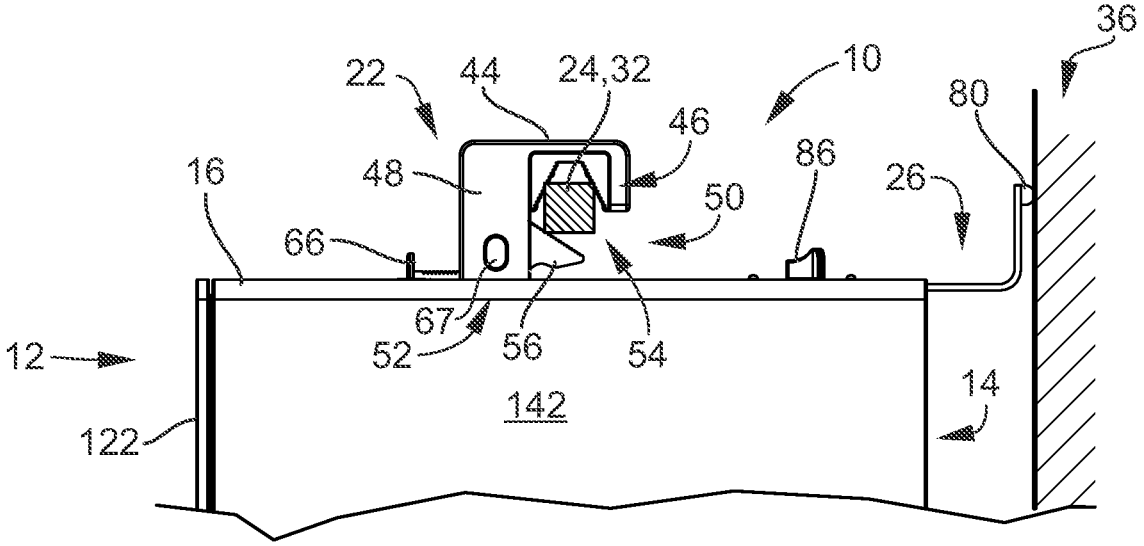
FIG. 10C is right side view of the top portion of the hanging storage enclosure of FIG. 1 hanging on a square closet rod.

Hanging mechanism 22 may lock to object 24, like closet rod 32, by any means. In select embodiments, as shown in the figures, hanging mechanism 22 can include top member 44 with notch 46 sized and configured to receive object 24, like closet rod 32. Front member 48 may be included and configured to support top member 44 at elevated position 50 above top side 16 of main frame 14. In addition, in select embodiments, adjustable lock 52 may be included with hanging mechanism 22. Adjustable lock 52 may be configured for locking object 24 in notch 46 of top member 44. Adjustable lock 52 may be configured to adjust to various size objects 54 received within notch 46 of top member 44 for locking the various sized objects 54 in notch 46 of top member 44, as shown in FIGS. 10A, 10B and 10C. Specifically, in FIG. 10A, adjustable lock 52 is shown locking onto a smaller circular shaped object 24 or closet rod 32. In FIG. 10B, adjustable lock 52 is shown locking onto a larger or oversized circular object 24 or closet rod 32. Finally, in FIG. 10C, adjustable lock 52 is shown locking onto a square shaped object or closet rod 32. In select embodiments, adjustable lock 52 may include, but is not limited to, having angled member 56 and movable groove plate 66. Angled member 56 may have friction top portion 58, and rounded bottom portion 60 with teeth 62. Angled member 56 may be connected to hanging mechanism 22 at pivot point 64 configured to pivot friction top portion 58 towards and away from notch 46 of top member 44. In addition, movable groove plate 66 may be configured to rotate angled member 56 via rounded bottom portion 60 by interacting with teeth 62 of rounded bottom portion 60. Whereby, when movable groove plate 66 is moved toward hanging mechanism 22, friction top portion 58 of angled member 56 may be moved towards notch 46 of top member 44 for locking object 24, like closet rod 32, into notch 46. In addition, when movable groove plate 66 is moved away from hanging mechanism 22, friction top portion 58 of angled member 56 may be moved away from notch 46 of top member 44 for unlocking object 24, like closet rod 32, out of notch 46. Release button 67 may be included that may be configured for releasing movable groove plate 66 and allow it to reverse direction thereby unlocking object 24 from notch 46. Notch 46 may include various desired shapes and sized for hanging and/or locking hanging mechanism 22 from object 24, like closet rod 32. In select embodiments, notch 46 of top member 44 may include trapezoid shape 68, as shown in the Figures. Trapezoid shape 68 may have wide open bottom 70. In select embodiments, the interior of trapezoid shape 68 may have friction grooves 72 configured for aiding in gripping object 24 in notch 46, like closet rod 32.

Top slide 26 may be included with hanging storage enclosure 10. Top slide 26 may be for positioning top side 16 of main frame 14, like for positioning top side 16 relative to rear closet wall 36. Top slide 26 may include any members, devices, mechanisms and/or means configured for positioning top side 16. Top slide 26 may be positioned on or in a pocket or groove on top side 16 of main frame 14. In select embodiments, top slide 26 may include top horizontal bracket 74 with top vertical bracket 76 at top distal end 78 of top horizontal bracket 74. Top vertical bracket 76 may be configured to be slid to and from top side 16 of main frame 14 via moving top horizontal bracket 74 along top side 16 of main frame 14. In select embodiments, top vertical bracket 76 may extend vertically upward from top horizontal bracket 74 and may include top rounded protrusion 80 at its top 82. Top rounded protrusion 80 may be configured for safely positioning top side 16 of main frame 14 against back closet wall 36 by providing a smooth rounded surface that will not easily scratch, dent or chip back closet wall 36, like a sheet rock wall. In select embodiments, top horizontal bracket 74 may include top slot 84 therethrough configured to receive top locking mechanism 86 while sliding along or in top side 16 of main frame 14. Top locking mechanism 86 may be configured for locking top horizontal bracket 74 in position on top side 16 of main frame 14 in locked top position 88, and for releasing top horizontal bracket 74 to slide along or in top side 16 of main frame 14 in top release position 90, as shown in FIG. 9. Top locking mechanism 86 may include a threaded nut configuration through top slot 84, where, when top locking mechanism 86 is rotated in one direction top locking mechanism 86 compresses down on top horizontal bracket 74 for locking it into locked top position 88, and when top locking mechanism 86 is rotated in the other direction, top locking mechanism 86 uncompresses or releases top horizontal bracket 74 for allowing top horizontal bracket 74 to slide on or in top side 16 of main frame 14 in top release position 90.

Bottom slide 28 may be included with hanging storage enclosure 10. Bottom slide 28 may be for positioning bottom side 18 of main frame 14, like for positioning bottom side 18 relative to rear closet wall 36. Bottom slide 28 may include any members, devices, mechanisms and/or means configured for positioning bottom side 18. Bottom slide 28 may be positioned on or in a pocket or groove on bottom side 18 of main frame 14. In select embodiments, bottom slide 28 may include bottom horizontal bracket 92 with bottom vertical bracket 94 at bottom distal end 96 of bottom horizontal bracket 92. Bottom vertical bracket 94 may be configured to be slid to and from bottom side 18 of main frame 14 via moving bottom horizontal bracket 92 along bottom side 18 of main frame 14. In select embodiments, bottom vertical bracket 94 may extend vertically downwards from bottom horizontal bracket 92 and may include bottom rounded protrusion 98 at its bottom 100. Bottom rounded protrusion 98 may be configured for safely positioning bottom side 18 of main frame 14 against back closet wall 36 by providing a smooth rounded surface that will not easily scratch, dent or chip back closet wall 36, like a sheet rock wall. In select embodiments, bottom horizontal bracket 92 may include bottom slot 102 therethrough configured to receive bottom locking mechanism 104 while sliding along or in bottom side 18 of main frame 14. Bottom locking mechanism 104 may be configured for locking bottom horizontal bracket 92 in position on or in bottom side 18 of main frame 14 in locked bottom position 106, and for releasing bottom horizontal bracket 92 to slide along or in bottom side 18 of main frame 14 in bottom release position 108, as shown in FIG. 9. Similar to top locking mechanism 86, bottom locking mechanism 104 may include a threaded nut configuration through bottom slot 102, where, when bottom locking mechanism 104 is rotated in one direction bottom locking mechanism 104 compresses down on bottom horizontal bracket 92 for locking it into locked bottom position 106, and when bottom locking mechanism 104 is rotated in the other direction, bottom locking mechanism 104 uncompresses or releases bottom horizontal bracket 92 for allowing bottom horizontal bracket 792 to slide on or in bottom side 18 of main frame 14 in bottom release position 108.

Figure 4:
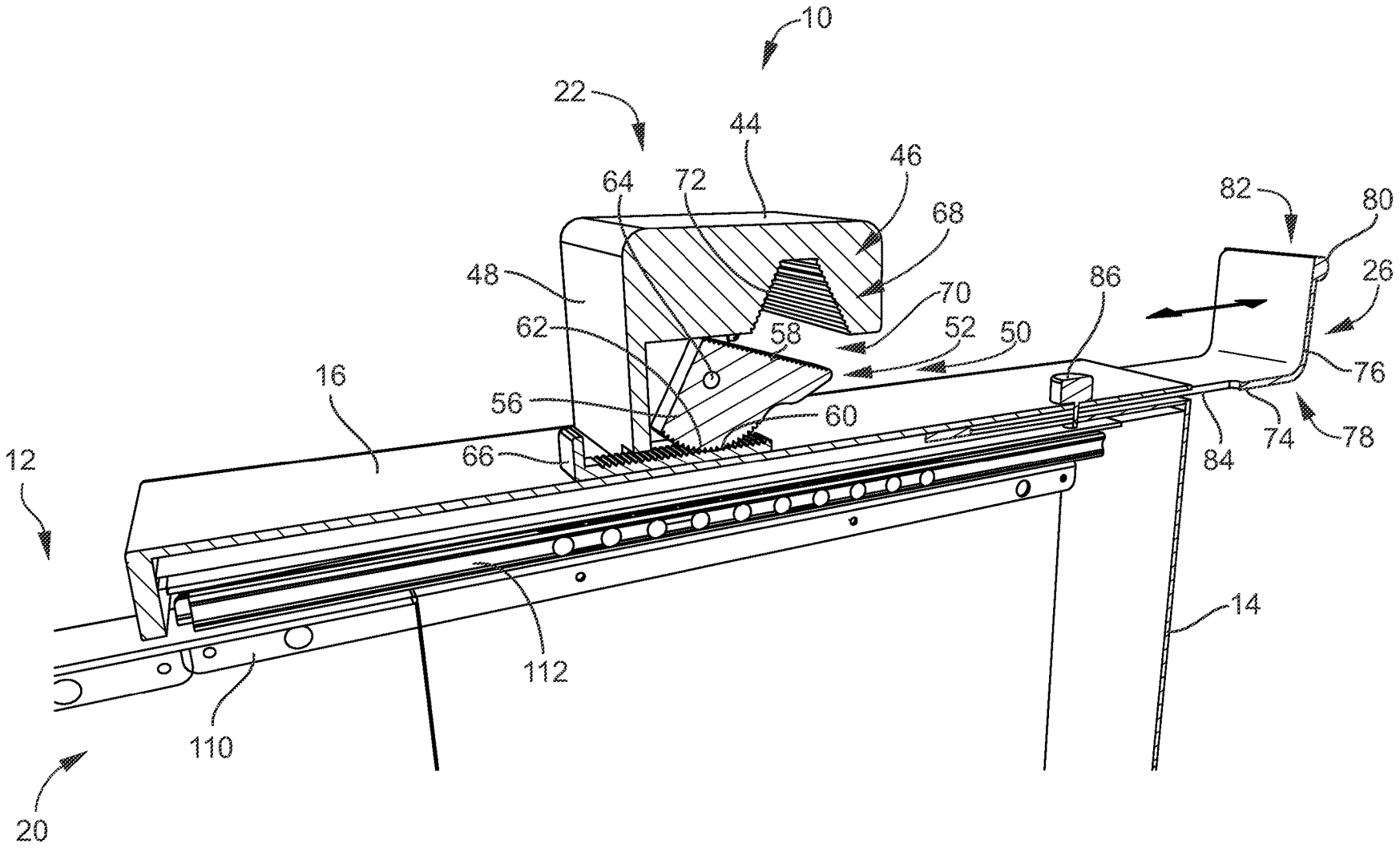
FIG. 4 is a cross-sectional perspective view of the top portion of the hanging storage enclosure of FIG. 1.
Figure 5:
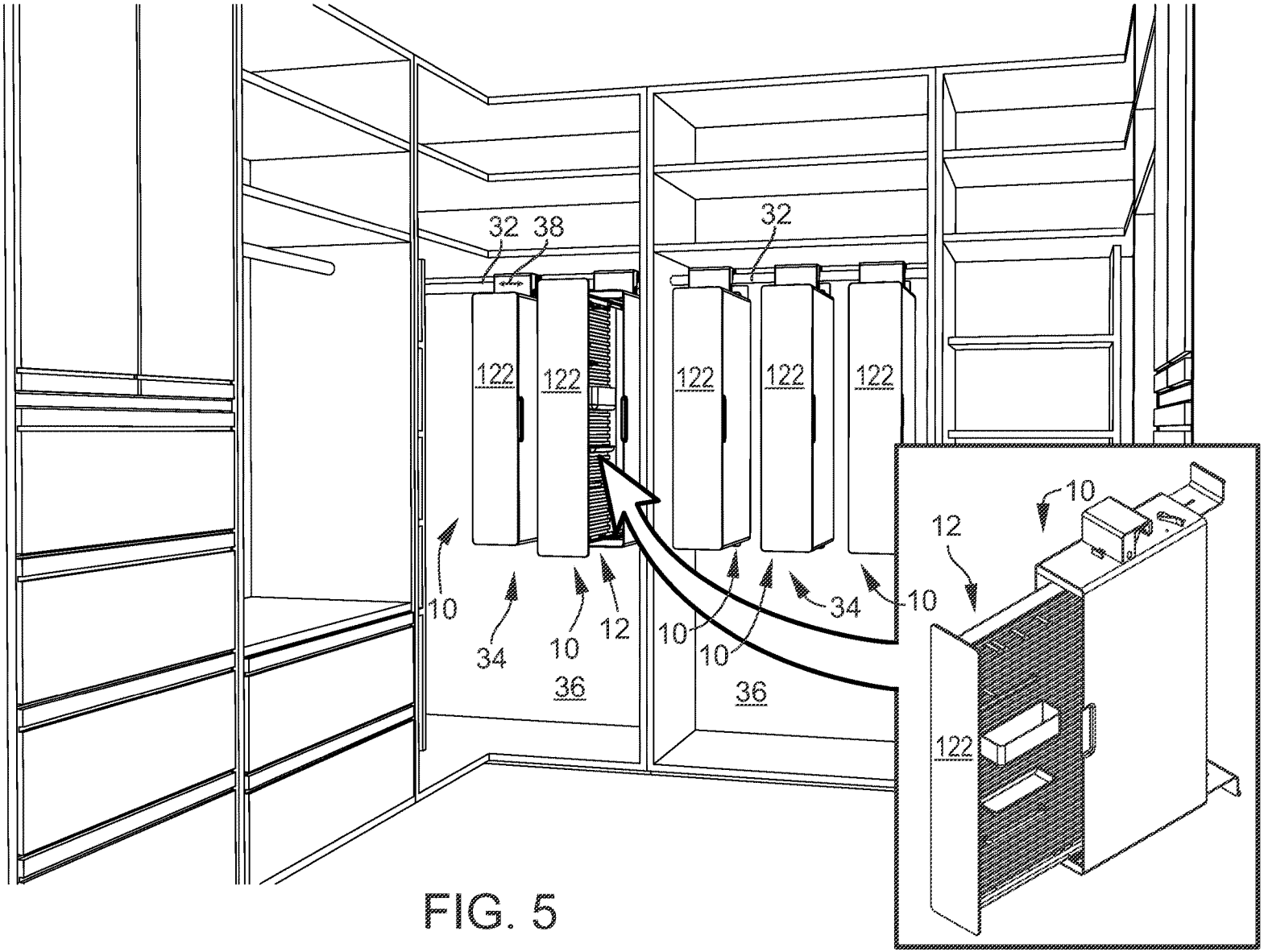
FIG. 5 is an environmental perspective view of multiple hanging storage enclosures of FIG. 1 installed on closet rods in a closet.
Figure 11:
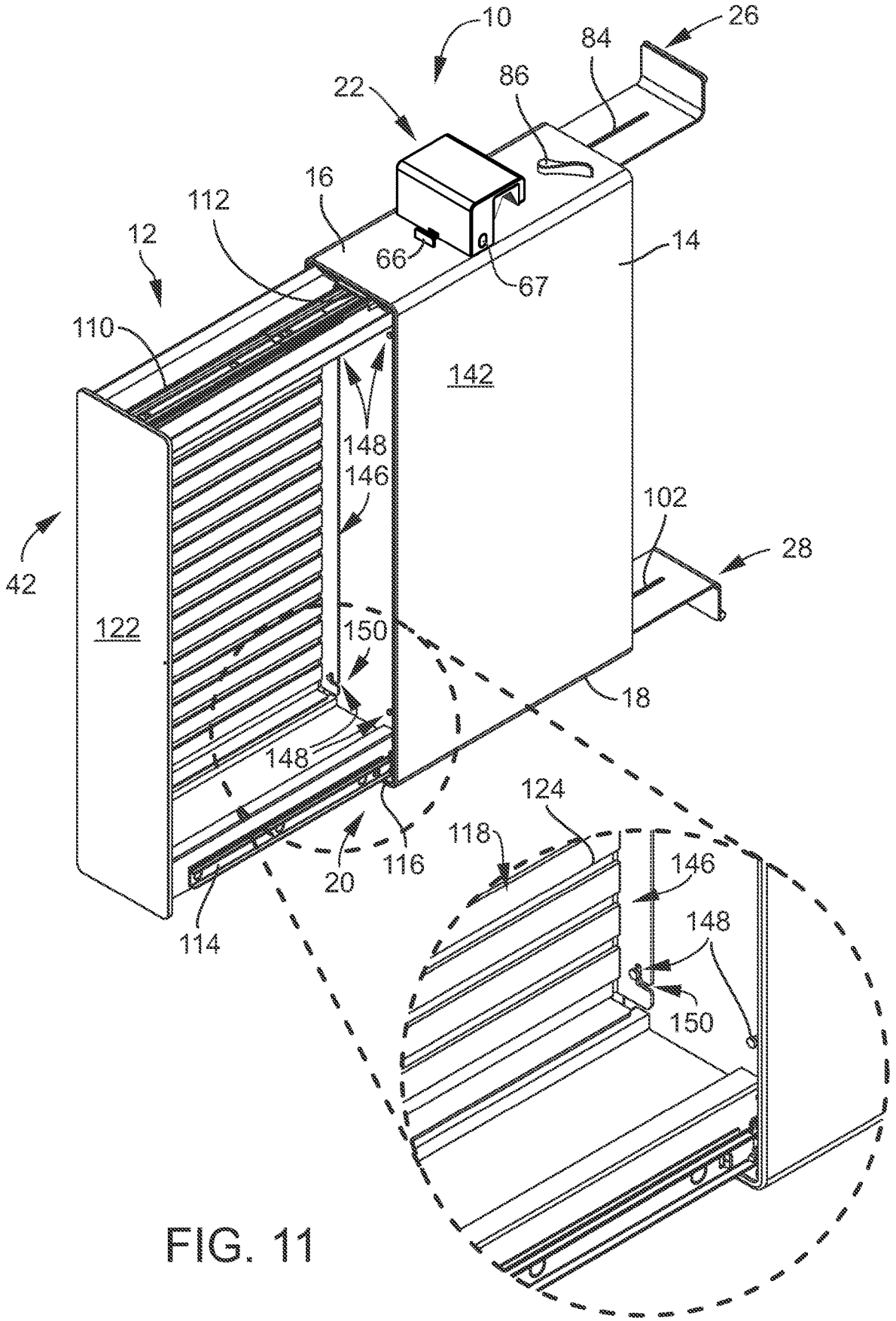
FIG. 11 is a front top perspective view of the hanging storage enclosure according to select embodiments of the instant disclosure with a reversible panel in the slide out drawer.
Figure 12:
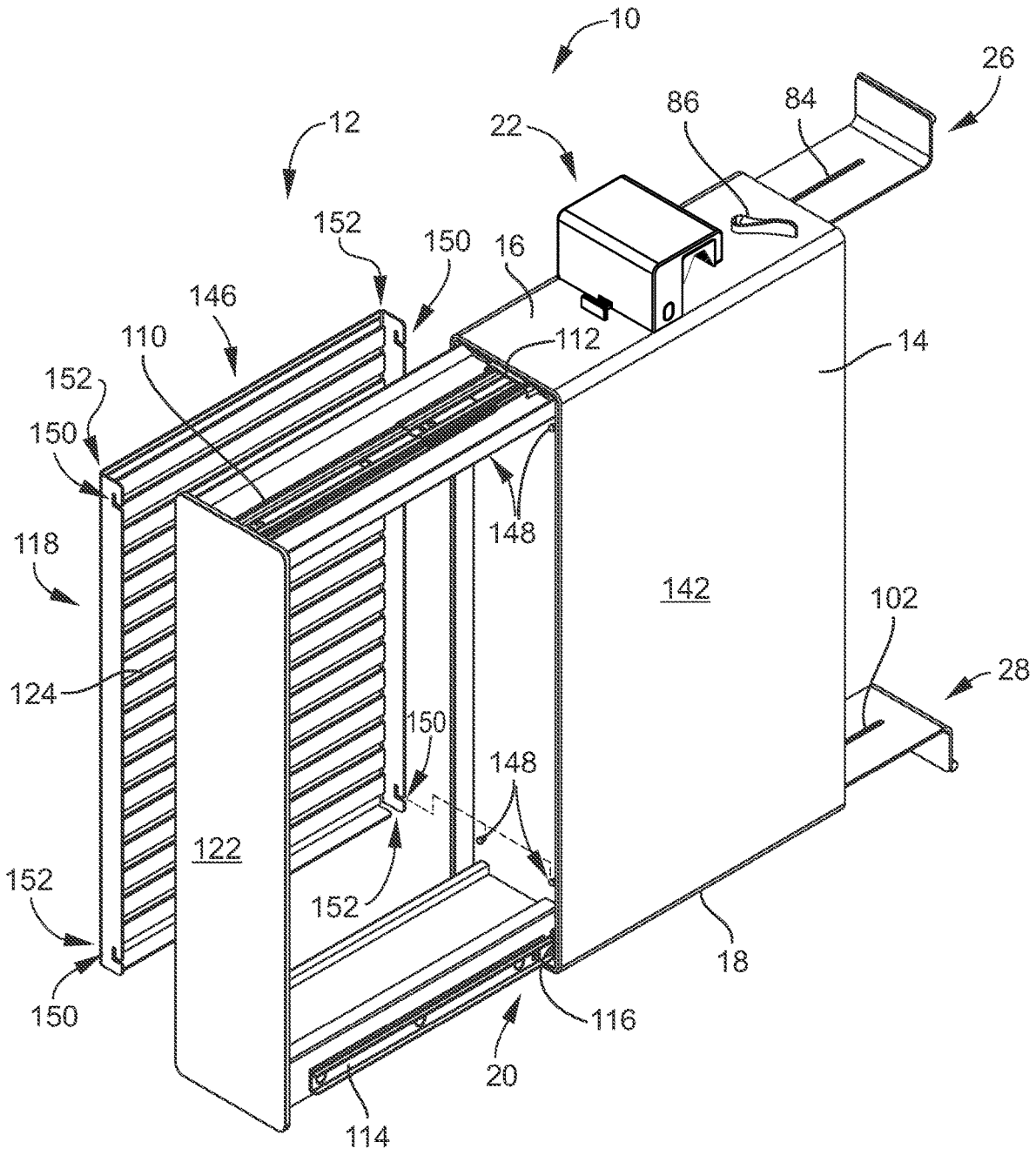
FIG. 12 is a front perspective view of the hanging storage enclosure of FIG. 11 with the reversible panel in the slide out drawer removed.

Hanging storage enclosure 10 may include any door, covering, or the like on open end 20 of main frame 14. In addition, hanging storage enclosure 10 may include any internal components or systems within hollow interior 15 of main frame 14. In select embodiments of hanging storage enclosure 10, drawer 12 may be included, or multiple drawers 12 may be included. Drawer 12 may be configured to fit inside hollow interior 15 of main frame 14, where drawer 12 may be configured to slide in and out of open front end 20 of main frame 14. Drawer 12 may be configured to slide in and out of main frame 14 through open front end 20. Drawer 12 may include any enclosure, mechanisms, members and/or means configured for allowing drawer 12 to slide in and out of open front end 20 of main frame 14. In select embodiments, drawer 12 may include at least one top rail 110 configured to slide in and out of a corresponding number of top tracks 112 positioned under top side 16 of main frame 14. As best shown in FIGS. 4, 11 and 12, in select embodiments a single top rail 110 may be centered on the top of drawer 12 and a single top track 112 may be centered under top side 16 of main frame 14 for aligning drawer 12 inside hollow interior 15 of main frame 14. In addition, in select embodiments of drawer 12, at least one bottom rail 114 may be included that is configured to slide in and out of a corresponding number of bottom tracks 116 positioned on top of bottom side 18 of main frame 14. As best shown in FIGS. 3, 9, 11, 12 and 13, a bottom rail 114 may be positioned on each side of the bottom of drawer 12 with a corresponding bottom track 116 positioned on inside of left side 140 and right side 142 of main frame 14. Another feature of hanging storage enclosure 10 may be that in select embodiments, when drawer 12 is opened in open position 42, which creates additional rotational forces 40 about closet rod 32, combination 30 of hanging mechanism 22, top slide 26 and bottom slide 28 may be configured to stabilize and position hanging storage enclosure 10 horizontally below closet rod 32 in horizontal orientation or position 34, while utilizing rear closet wall 36 for stabilizing this horizontal position 34 below closet rod 32, even with drawer 12 slid completely out of main frame 14, as shown in FIG. 9.

Vertical panel 118 may be included with drawer 12 of hanging storage enclosure 10. Vertical panel 118 may be for providing a device or means for storing a variety of items, including, but not limited to, jewelry, watches, documents, electronic devices, articles, the like, etc. Vertical panel 118 may include any device, member, mechanisms, or means for storing items desired to be stored in hanging storage enclosure 10. Vertical panel 118 may be connected between top rail 110 and bottom rail 114. Vertical panel 118 may be configured for storing any personal items or the like. In select embodiments, vertical panel 118 may include plurality of niches 124 configured for attaching plurality of accessory holders 126 on vertical panel 118 of drawer 12. Accessory holders 126 may include, but are not limited to, shelf 128, container 130, horizontal bar 132, rack 134, hook 136, dowel 138, the like, or combinations thereof. With various accessory holders 126 and plurality of niches 124, drawer 12 may be designed and configured to store many different items in many different configurations or orientations as the user may desire. In other select embodiments of drawer 12, front cap 122 may be included. Front cap 122 may be configured for closing open front end 20 of main frame 14 when drawer 12 is slid into hollow interior 15 of main frame 14. Front cap 122 may also be designed or configured to aid in pulling out drawer 12 from main frame 13 and/or pushing drawer 12 into main frame 14. Front cap 122 may include various drawer hardware or the like configured for aiding in the movement of drawer 12. In addition, in select embodiments, as shown in the figures, left side 140 and/or right side 142 may include indention 144 configured for aiding in gripping front cap 122 of drawer 12 for sliding drawer 12 out of main frame 14.

Referring now specifically to the embodiments shown in FIGS. 11-14, another feature of hanging storage enclosure 10 may be that vertical panel 118 of drawer 12 may be reversible panel 146. Reversible panel 146 may be configured to store the items on either side of vertical panel 118. Reversible panel 146 may be reversible by any devices, mechanisms, member, means, or the like. In select embodiments, as shown in FIGS. 11-14, reversible panel 146 may include four L-shaped slots 150. Each of the four L-shaped slots 150 may be positioned approximate a corner 152 of reversible panel 146. Accordingly, drawer 12 may include two sets of four corresponding pins 148, where one set of the four corresponding pins 148 is configured for positioning reversible panel 146 on the left side of drawer 12, and the other set of the four corresponding pins 148 is configured for positioning reversible panel 146 on the right side of drawer 12.

Figure 2:
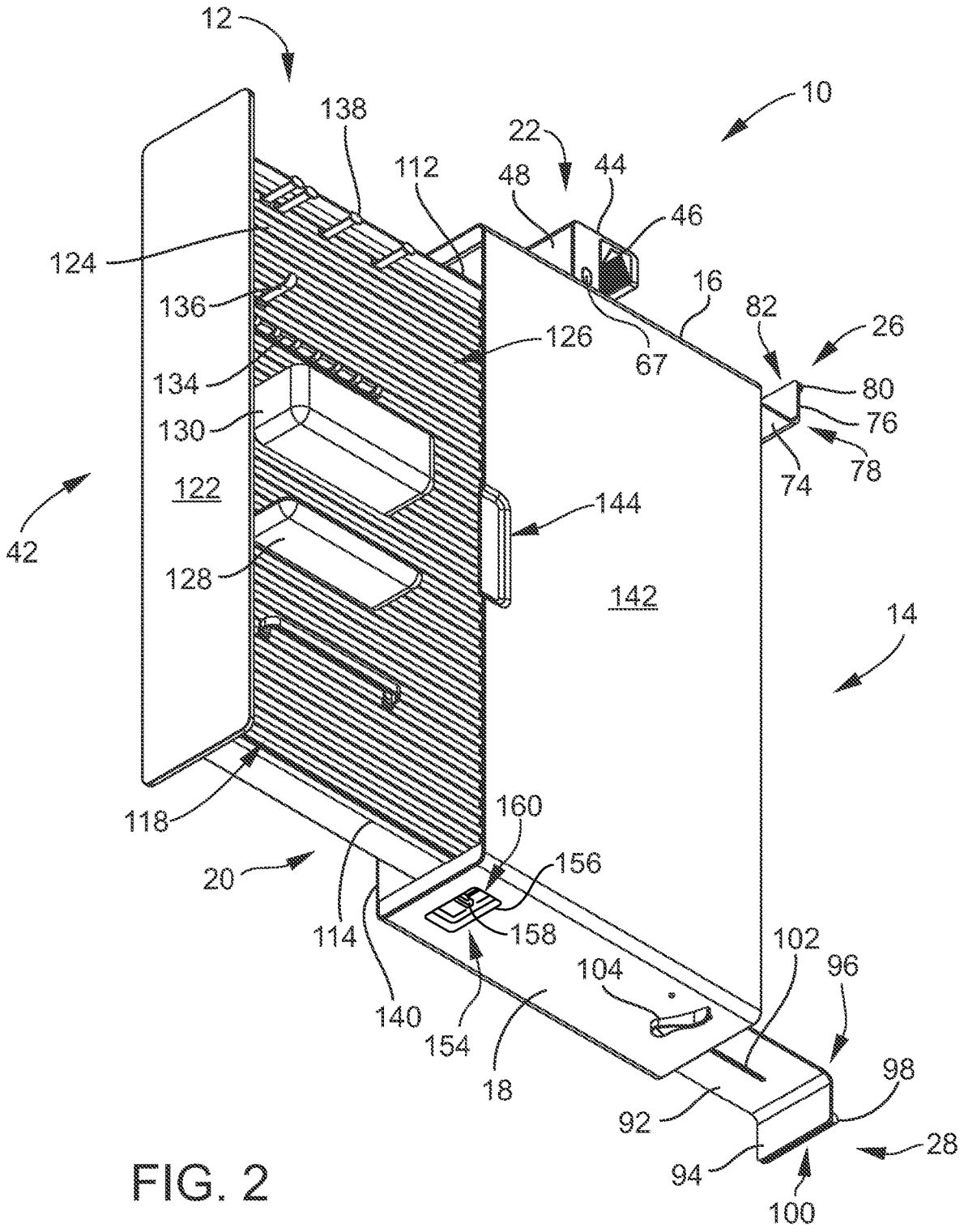
FIG. 2 is a front bottom perspective view of the hanging storage enclosure of FIG. 1.
Figure 3:
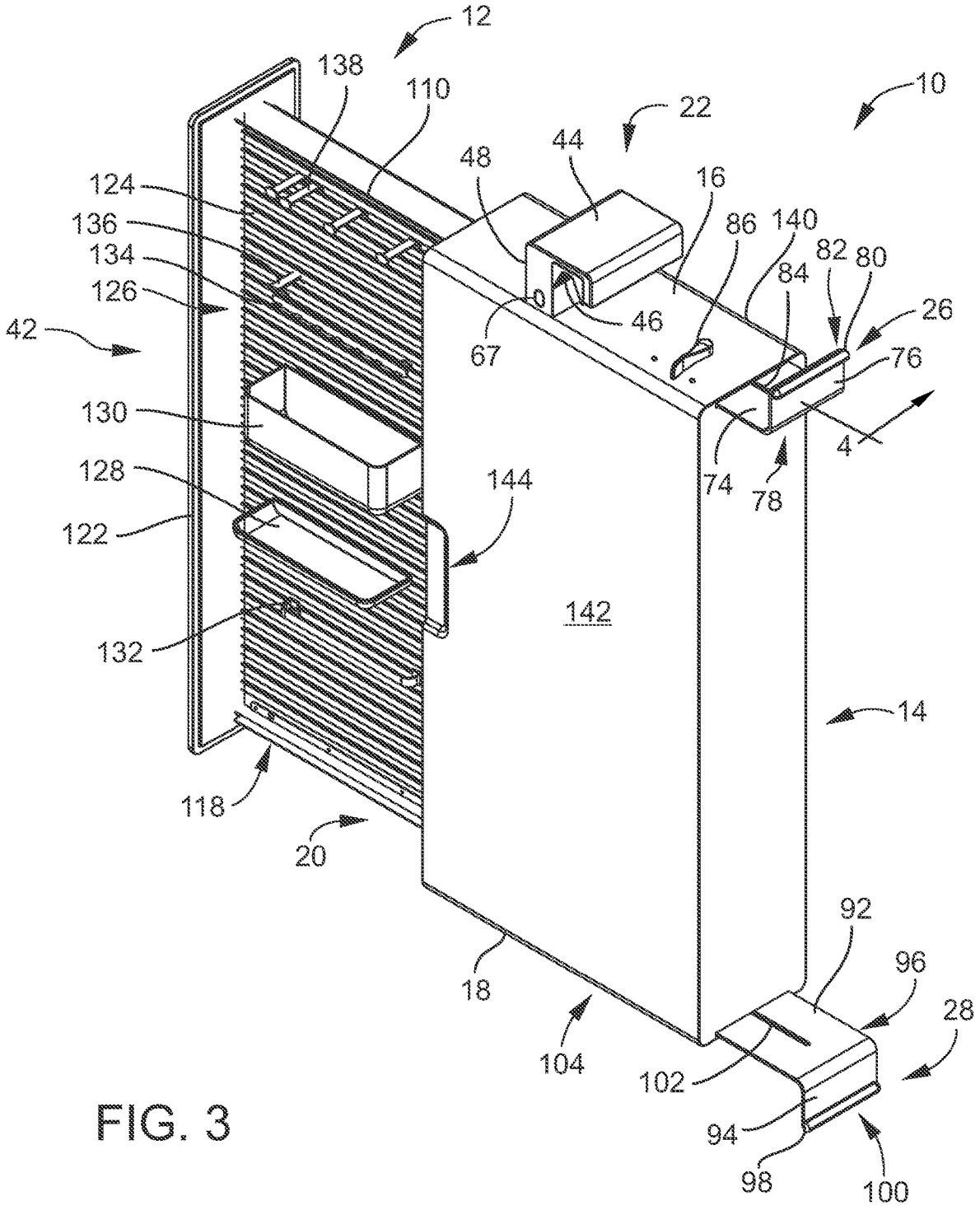
FIG. 3 is a back top perspective view of the hanging storage enclosure of FIG. 1.
Figure 13:
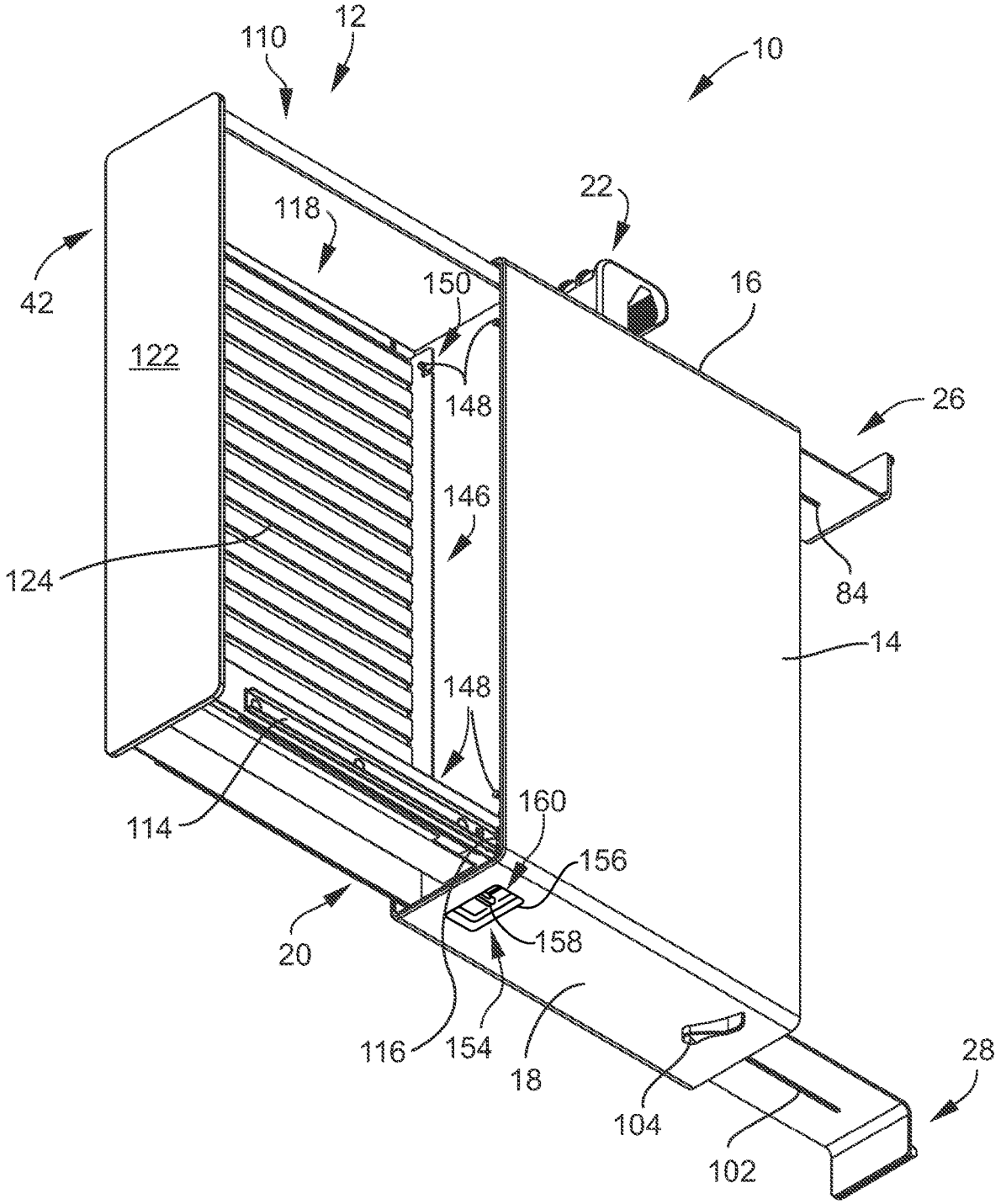
FIG. 13 is a front bottom perspective view of the hanging storage enclosure of FIG. 11
Figure 14:
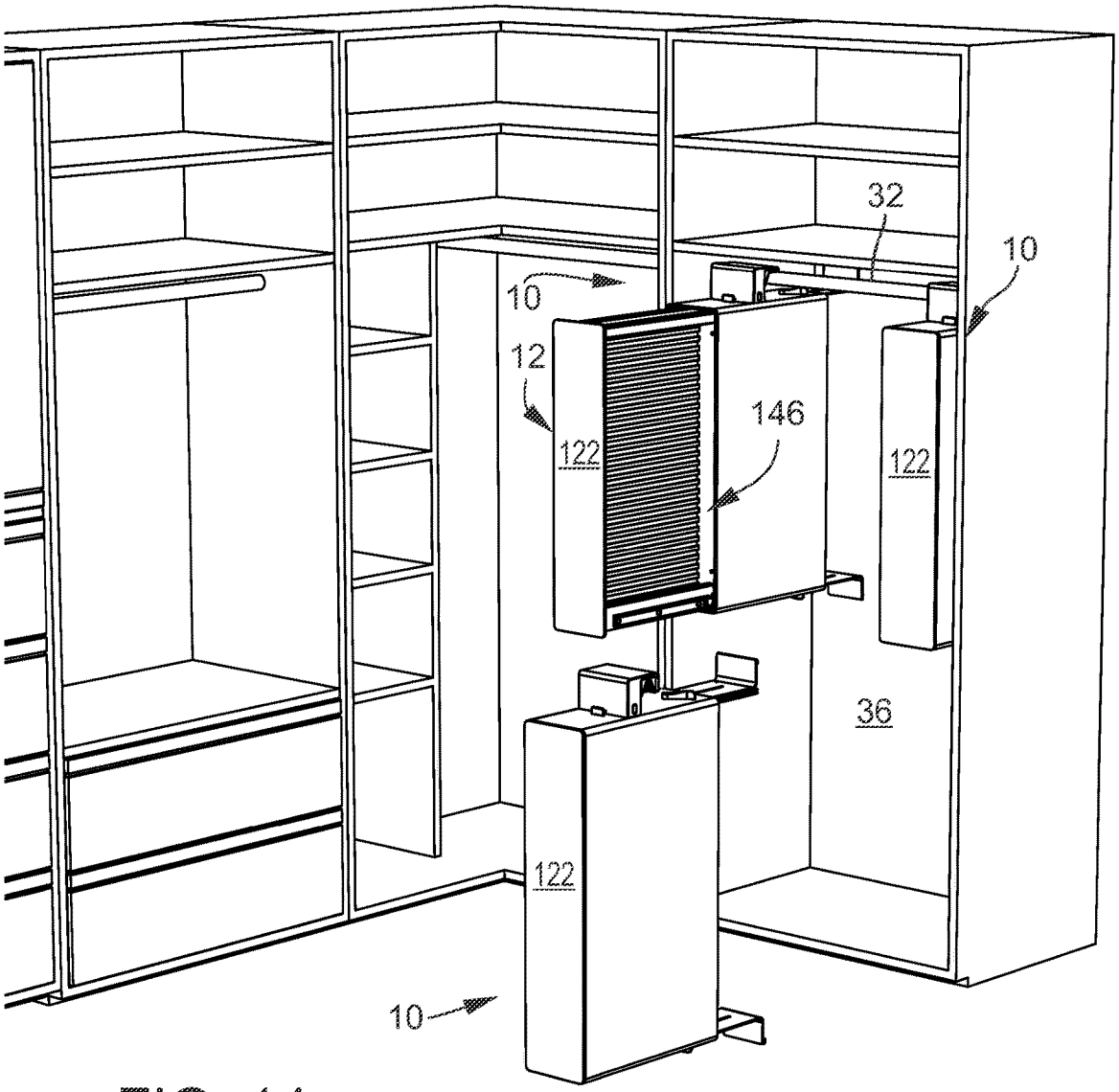
FIG. 14 is an environmental perspective view of multiple hanging storage enclosures of FIG. 11 installed on a closet rod in a closet.

Referring now specifically to the embodiments shown in FIGS. 2 and 13, another feature of hanging storage enclosure 10 may be the inclusion of opening locking mechanism 154. Opening locking mechanism 154 may be configured to lock open front end 20 of main frame 14, like for securing items inside of hollow interior 15 of main frame 14. Opening locking mechanism 154 may be positioned anywhere on main frame 14 and may be include any devices, mechanism, members or means for locking open end 20 of main frame 14 for securing items inside of hollow interior 15 of main frame 14. In select embodiments, and clearly not limited thereto, as shown in FIGS. 2 and 13, opening locking mechanism 154 may include cutout 156 and holed protrusion 158. Cutout 154 may be positioned anywhere on main frame 14, including in bottom side 18 of main frame 14, as shown in FIGS. 2 and 13. Holed protrusion 158 may be positioned in cutout 156 on bottom side 18 of main frame 14. Holed protrusion 158 may be configured for receiving padlock 160, or other like locking device, for locking drawer 12 to holed protrusion 158, thereby locking drawer 12 inside of main frame 14.

In sum, hanging storage enclosure 10 may be configured for storage of many different personal items such as scarves, jewelry, watches, documents, electronics, collectibles, etc. As examples, and clearly not limited thereto, hanging storage enclosure 10 may be used in closets for:

Teen or Kids Room—As a design example, one could change front design of front cap 122 slightly to resemble an actual school locker. Hanging storage enclosure 10 could have storage for games, electronics, headphones, books, school supplies, etc.;

Baby—Multiple slide out drawers 12 could be for diaper storage, wipes, powder, medicines, etc. In addition, hanging storage enclosure 10 could have specialized interior components designed for common baby items such as diapers and wipes;

Athletic equipment and Hat/ball cap storage—Hanging storage enclosure 10 could be especially appealing to athletes on sports teams and could have specialized interior components designed for storing equipment pertaining to sports such as ball caps, gloves, cleats, pads, etc.;

In addition, concepts for use of hanging storage enclosure 10 outside the closet can include versions for bathrooms, kitchen, pantry, garage, laundry room, mud room, etc.

One feature or advantage of hanging storage enclosure 10 can be the adjustable supports in the back of the unit, i.e. top slide 26 and bottom slide 28, that enable slide out drawer 12 to open without tipping. This unique feature is important because without a means to brace the main body of hanging storage enclosure 10, it would tip dramatically when the drawer was pulled open.

Another feature or advantage of hanging storage enclosure 10 is hanging mechanism 22 with tightening/locking feature of adjustable lock 52. The interior portion of the hook or hanging mechanism 22 can be designed to compression fit against closet rod 32, where adjustable lock 52 is configured to positively secure hanging storage enclosure 10 to closet rod 32.

Another feature or advantage of hanging storage enclosure 10 may be friction grooves 72 or a rubberized hook interior of hanging mechanism 22, which can be for better grip on closet rod 32. This feature could also be designed so that gravity and the weight of hanging storage enclosure 10 could increase tightening on closet rod 32. In addition the teardrop or trapezoidal hook shape 68 may be configured to accommodate a range of closet rod diameters and shapes. As another option to the teardrop shape, a multi-tiered hook shape could be used to accommodate a range of closet rod diameters.

Another optional feature could be a built in level. Although not shown in the drawings, this built in level could simply be a feature that could be added to assist in the installation of the product. A small level could be incorporated into the main frame 14, like on top side 16.

Another optional feature could be a built in light that turns on when drawer 12 is opened. This lighting feature would likely be a battery-powered LED ("light emitting diode") light that would illuminate the interior of the unit once drawer 12 was opened Another optional feature could be to have one or more pull out drawers 12 in a single hanging storage enclosure 10. As such, the instant disclosure is not limited to the single drawer 12 configuration shown in the figures. Instead, the instant disclosure embraces other versions of this product that have multiple drawers 12 that open together or independently Another optional feature could be to have drawer 12 pull open, as shown in the Figures, or pivot open like a traditional door. As such, the configuration of drawer 12 could be like a drawer system or a locker system.

Another optional feature is that the exterior door could be mirrored, like on front cap 122 of drawer 12.

Another optional feature could be that college and other sports licensing opportunities could be incorporated into the design. As an example, a licensed hanging storage enclosure 10 could incorporate the name, logo, mascot, likeness, etc. of a professional sports team or college or university which would be ideal for use in locker room facilities for athletes, or in dorm rooms for students.

Another optional feature could be the surface of hollow interior 15 of main frame 14, drawer 12, or vertical panel 118 could be flocked or coated with other soft or rubberized surface to protect contents stored within from abrasion or sliding.

Another feature is that the interior can be configured/customized based on user preferences. Various hooks, shelves, pockets, etc. can be included which can then be rearranged for the user to store their preferred items.

Another optional feature could be that the design of exterior shape could change depending on the intended use. For example, a version could be made that is wider for storing folded sweaters, or narrower for belts and scarves. As such, hanging storage enclosure 10 does not have to be a hanging rectangle, as shown in the figures, but could be made in a number of different shapes.

Another optional feature can be that the hanging mechanism could be moved or configured to hook on a traditional mud room coat hook to provide storage for gloves, hats, scarves, etc.

Another optional feature can be that the exterior of hanging storage enclosure 10 could contain exterior pockets, mirrors, a white board for making notes, key hooks and other compartments or shelves.

Another optional feature can be that the hanging mechanism could be moved or configured to be used in the pantry for storing spices, kitchen tools, recipe books, etc. This version of hanging storage enclosure 10 would not hang on a closet rod, but could still incorporate the supports of top slide 26 and bottom slide 28 to brace main frame 14 and allow it to contain slide out drawers 12 without tipping.

Another optional feature of hanging storage enclosure 10 may be that there are many different construction and material options including injection molded plastic, vacuum formed plastic, formed metal, cast metal, wood, etc.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A hanging storage enclosure comprising:

a main frame with a hollow interior having a top side, a bottom side, an open front end, and a back on an opposite side of the main frame from the open front end;

a hanging mechanism on the top side of the main frame, the hanging mechanism is configured to hang the main frame from an object;

a top slide positioned on the top side of the main frame, the top slide is configured to slide in and out from the back of the main frame approximate the top side of the main frame, wherein the top slide is configured for positioning the top side of the main frame, the top slide positioned on the top side of the main frame includes a top horizontal bracket with a top vertical bracket at a top distal end of the top horizontal bracket, wherein the top vertical bracket is configured to be slid to and from the top side of the main frame; and a bottom slide positioned on the bottom side of the main frame, the bottom slide is configured to slide in and out from the back of the main frame approximate the bottom side of the main frame, wherein the bottom slide is configured for positioning the bottom side of the main frame, the bottom slide positioned on the bottom side of the main frame includes a bottom horizontal bracket with a bottom vertical bracket at a bottom distal end, wherein the bottom vertical bracket is configured to be slid to and from the bottom side of the main frame.

2. The hanging storage enclosure of claim 1 wherein a combination of the hanging mechanism, the top slide and the bottom slide is configured to stabilize and position the hanging storage enclosure horizontally below the object.

3. The hanging storage enclosure of claim 2, wherein the object is a closet rod and the hanging mechanism is configured to hang the main frame from the closet rod;

wherein the combination of the hanging mechanism, the top slide and the bottom slide is configured to stabilize and position the hanging storage enclosure horizontally below the closet rod.

4. The hanging storage enclosure of claim 3, where the closet rod is positioned in front of a rear closet wall, wherein:

the top slide is configured for positioning the top side of the main frame relative to the rear closet wall below the closet rod; and the bottom slide is configured for positioning the bottom side of the main frame relative to the rear closet wall below the closet rod;

wherein the combination of the hanging mechanism, the top slide and the bottom slide is configured to stabilize and position the hanging storage enclosure horizontally below the closet rod while utilizing the rear closet wall for stabilizing a horizontal position of the hanging storage enclosure below the closet rod.

5. The hanging storage enclosure of claim 4, wherein the hanging mechanism is configured to lock onto the closet rod, wherein:

when the hanging mechanism is locked onto the closet rod, the hanging mechanism is configured to stabilize the hanging storage enclosure from traveling transversely along the closet rod;

when the hanging mechanism is locked onto the closet rod, the hanging mechanism is configured to prevent the hanging storage enclosure from lifting vertically and inadvertently being removed from the closet rod;

when the hanging mechanism is locked onto the closet rod, the hanging mechanism is configured to reduce the hanging storage enclosure from rotating about the closet rod;

or combinations thereof.

6. The hanging storage enclosure of claim 1, wherein the hanging mechanism including:

a top member with a notch sized and configured to receive the object;

a front member configured to support the top member at an elevated position above the top side of the main frame; and an adjustable lock configured to adjust to various size objects received within the notch of the top member for locking the various sized objects in the notch of the top member.

7. The hanging storage enclosure of claim 6, wherein the adjustable lock including:

an angled member with a friction top portion, and a rounded bottom portion with teeth;

the angled member is connected to the hanging mechanism at a pivot point configured to pivot the friction top portion towards and away from the notch of the top member; and a movable groove plate configured to rotate the angled member via the rounded bottom portion with the teeth, whereby:

when the movable groove plate is moved toward the hanging mechanism, the friction top portion of the angled member is moved towards the notch of the top member for locking the object into the notch; and when the movable groove plate is moved away from the hanging mechanism, the friction top portion of the angled member is moved away from the notch of the top member for unlocking the object out of the notch;

a release button configured for releasing the movable groove plate and allow it to reverse direction thereby unlocking the object from the notch;

wherein the notch of the top member including a trapezoid shape with a wide open bottom, where the interior of the trapezoid shape has friction grooves.

8. The hanging storage enclosure of claim 1, wherein:

the top vertical bracket extends vertically upward from the top horizontal bracket and includes a top rounded protrusion at its top configured for safely positioning the top side of the main frame against a back closet wall; and the bottom vertical bracket extends vertically downwards from the bottom horizontal bracket and includes a bottom rounded protrusion at its bottom configured for safely positioning the bottom side of the main frame against the back closet wall.

9. The hanging storage enclosure of claim 8, wherein:

the top horizontal bracket includes a top slot therethrough configured to receive a top locking mechanism while sliding along the top side of the main frame, where the top locking mechanism is configured for locking the top horizontal bracket in position on the top side of the main frame in a locked top position, and for releasing the top horizontal bracket to slide along the top side of the main frame in a top release position; and the bottom horizontal bracket includes a bottom slot therethrough configured to receive a bottom locking mechanism while sliding along the bottom side of the main frame, where the bottom locking mechanism is configured for locking the bottom horizontal bracket in position on the bottom side of the main frame in a locked bottom position, and for releasing the bottom horizontal bracket to slide along the bottom side of the main frame in a bottom release position.

10. The hanging storage enclosure of claim 1 further comprising at least one drawer configured to fit inside the hollow interior of the main frame, the at least one drawer is configured to slide in and out of the open front end of the main frame.

11. The hanging storage enclosure of claim 10, wherein the drawer including:

at least one top rail configured to slide in and out of a corresponding number of top tracks positioned under the top side of the main frame;

at least one bottom rail configured to slide in and out of a corresponding number of bottom tracks positioned on top of the bottom side of the main frame;

a vertical panel connected between the at least one top rails and the at least one bottom rails configured for storing items on one or both sides; and a front cap configured for closing the open front end of the main frame when the drawer is slid into the main frame;

wherein, when the drawer is opened thereby creating additional rotational forces about the object, the combination of the hanging mechanism, the top slide and the bottom slide is configured to stabilize and position the hanging storage enclosure horizontally below the object while utilizing the rear closet wall for stabilizing the horizontal position below the object even with the drawer is slid completely out of the main frame.

12. The hanging storage enclosure of claim 11, wherein the vertical panel including a plurality of niches configured for attaching a plurality of holders on the vertical panel of the drawer for placing and storing items, wherein the plurality of holders including: a shelf, a container, a horizontal bar, a rack, hooks, a dowel, or combinations thereof.

13. The hanging storage enclosure of claim 11, wherein the vertical panel is a reversible panel, the reversible panel is configured to be fastened to either the left or right side of the drawer, wherein:

the reversible panel including four L-shaped slots, where each of the four L-shaped slots is positioned approximate a corner of the reversible panel; and the drawer including two sets of four corresponding pins, where one set of the four corresponding pins is configured for positioning the reversible panel on the left side of the drawer, and another set of the four corresponding pins is configured for positioning the reversible panel on the right side of the drawer.

14. The hanging storage enclosure of claim 1, wherein the main frame including an opening locking mechanism configured to lock the open front end of the main frame for securing items inside of the main frame.

15. The hanging storage enclosure of claim 14, wherein the opening locking mechanism including:

a cutout in the bottom side of the main frame;

a holed protrusion in the cutout configured for receiving a padlock for locking a drawer to the holed protrusion thereby locking the drawer inside of the main frame.

16. The hanging storage enclosure of claim 1, wherein the main frame including a left side and a right side configured for concealing a drawer in the main frame of the hanging storage enclosure.

17. The hanging storage enclosure of claim 16, wherein the left side or the right side including an indention configured for gripping a front cap of the drawer for sliding out the drawer from the main frame.

18. A hanging storage enclosure comprising:

a main frame with a hollow interior having a top side, a bottom side, and an open front end;

a drawer configured to fit inside the hollow interior of the main frame, the drawer is configured to slide in and out of the open front end of the main frame, the drawer including a vertical panel configured for storing items; wherein the vertical panel is a reversible panel, the reversible panel is configured to be placed on either side of the drawer, wherein:

the reversible panel including four L-shaped slots, where each of the four L-shaped slots is positioned approximate a corner of the reversible panel; and the drawer including two sets of four corresponding pins, where one set of the four corresponding pins is configured for positioning the reversible panel on the left side of the drawer, and another set of the four corresponding pins is configured for positioning the reversible panel on the right side of the drawer;

a hanging mechanism on the top side of the main frame, the hanging mechanism is configured to hang the main frame from an object;

a top slide positioned on the top side of the main frame, the top slide is configured to slide in and out of the top side of the main frame, wherein the top slide is configured for positioning the top side of the main frame; and a bottom slide positioned on the bottom side of the main frame, the bottom slide is configured to slide in and out of the bottom side of the main frame, wherein the bottom slide is configured for positioning the bottom side of the main frame.

19. A hanging storage enclosure comprising:

a main frame with a hollow interior having a top side, a bottom side, an open front end, and a back on an opposite side of the main frame from the open front end;

a hanging mechanism on the top side of the main frame, the hanging mechanism is configured to hang the main frame from an object;

a top slide positioned on the top side of the main frame, the top slide is configured to slide in and out from the back of the main frame approximate the top side of the main frame, wherein the top slide is configured for positioning the top side of the main frame; and a bottom slide positioned on the bottom side of the main frame, the bottom slide is configured to slide in and out from the back of the main frame approximate the bottom side of the main frame, wherein the bottom slide is configured for positioning the bottom side of the main frame;

wherein the hanging mechanism including:

a top member with a notch sized and configured to receive the object a front member configured to support the top member at an elevated position above the top side of the main frame; and an adjustable lock configured to adjust to various size objects received within the notch of the top member for locking the various sized objects in the notch of the top member; the adjustable lock including:

an angled member with a friction top portion, and a rounded bottom portion with teeth;

the angled member is connected to the hanging mechanism at a pivot point configured to pivot the friction top portion towards and away from the notch of the top member; and a movable groove plate configured to rotate the angled member via the rounded bottom portion with the teeth, whereby:

when the movable groove plate is moved toward the hanging mechanism, the friction top portion of the angled member is moved towards the notch of the top member for locking the object into the notch; and when the movable groove plate is moved away from the hanging mechanism, the friction top portion of the angled member is moved away from the notch of the top member for unlocking the object out of the notch;

a release button configured for releasing the movable groove plate and allow it to reverse direction thereby unlocking the object from the notch;

wherein the notch of the top member including a trapezoid shape with a wide open bottom, where the interior of the trapezoid shape has friction grooves.

* * * * *